US005589840A

United States Patent [19]

Fujisawa

[11] Patent Number: 5,589,840

[45] Date of Patent: Dec. 31, 1996

[54] WRIST-TYPE WIRELESS INSTRUMENT AND ANTENNA APPARATUS

[75] Inventor: Teruhiko Fujisawa, Nagano-ken, Japan

[73] Assignee: Seiko Epson Corporation, Tokyo, Japan

[21] Appl. No.: 449,482

[22] Filed: May 24, 1995

Related U.S. Application Data

[63] Continuation-in-part of Ser. No. 81,380, Jun. 29, 1993, Pat. No. 5,465,098.

[30] Foreign Application Priority Data

Nov. 5, 1991 [JP] Japan ..... 3-288763
Jul. 19, 1994 [JP] Japan ..... 6-167095

[51] Int. Cl.[6] ..... H01Q 1/12; H01Q 13/10

[52] U.S. Cl. ..... 343/718; 343/767; 343/866

[58] Field of Search ..... 343/718, 702, 343/767, 768, 866, 867, 873; 340/573, 539, 568, 693; H01Q 1/24, 13/00, 7/00, 1/12, 13/10

[56] References Cited

U.S. PATENT DOCUMENTS

| | | | |
|---|---|---|---|
| 2,507,528 | 5/1950 | Kandogan | 343/767 |
| 2,629,051 | 2/1953 | Lindenblad | 343/767 |
| 3,172,112 | 3/1965 | Seeley | 343/767 |
| 3,210,766 | 10/1965 | Parker | 343/743 |
| 3,918,062 | 11/1975 | Haruki et al. | 343/702 |
| 4,034,621 | 7/1977 | Ritter, Jr. | 74/424 |
| 4,035,807 | 7/1977 | Tang et al. | 343/742 |

(List continued on next page.)

FOREIGN PATENT DOCUMENTS

| | | | |
|---|---|---|---|
| 0122485 | 10/1984 | European Pat. Off. . | |
| 0372430 | 6/1990 | European Pat. Off. . | |
| 0538485 | 4/1993 | European Pat. Off. . | |
| 0565725A1 | 10/1993 | European Pat. Off. . | |
| 2110012 | 9/1972 | Germany . | |
| 3806504AI | 9/1989 | Germany . | |
| 31-5906 | 7/1956 | Japan . | |
| 55-12762 | 1/1980 | Japan . | |
| 56-27514 | 3/1981 | Japan . | |
| 56-169401 | 12/1981 | Japan . | |
| 58-94204 | 6/1983 | Japan . | |
| 59-44103 | 3/1984 | Japan . | |
| 61-26307 | 2/1986 | Japan . | |
| 61-181203 | 8/1986 | Japan | 343/718 |
| 61-200702 | 9/1986 | Japan . | |
| 61-50542 | 11/1986 | Japan . | |
| 62-24705 | 2/1987 | Japan . | |
| 63-163185 | 6/1988 | Japan . | |
| 64-40002 | 2/1989 | Japan . | |

(List continued on next page.)

OTHER PUBLICATIONS

Hideo Ito et al., "A Small–Loop Antenna for Pocket–Size VHF Radio Equipment," *National Technical Report*, vol. 19 No. 2, Apr. 1973.

K. Fujimoto et al., "Small Antennas," *Research Studies Press Ltd.*

Teruhiko Fujisawa et al., "A Study on Small Slot Antenna for Wrist Watch Type Portable Radio Equipment," Technical Report of IEICE.

*Primary Examiner*—Hoanganh T. Le
*Attorney, Agent, or Firm*—Oliff & Berridge

[57] ABSTRACT

A wrist-type wireless instrument equipped with an antenna body that is formed on a wrist band is disclosed. The wireless instrument provides a simple compact arrangement within the wireless instrument casing and provides a large antenna gain. The wireless instrument is equipped with first and second wrist band members 21*a* and 21*b* respectively connected to each side of a wireless instrument casing 20 containing a wireless instrument circuit. A conductive plate 24 is fixed to the first and second wrist band members 21*a* and 21*b*. A slot 25 is formed in the conductive plate 24 so as to extend in the length dimension of the band. A capacitive element 26 is loaded across two divided sections of the conductive plate 24 that are defined by the slot 25, at a position substantially in the middle portion with respect to the length dimension of the conductive plate 24.

8 Claims, 7 Drawing Sheets

U.S. PATENT DOCUMENTS

| | | | |
|---|---|---|---|
| 4,419,770 | 12/1983 | Yagi et al. | 455/301 |
| 4,509,053 | 4/1985 | Robin et al. | 343/708 |
| 4,713,808 | 12/1987 | Gaskill et al. | 343/718 |
| 4,775,866 | 10/1988 | Shibata et al. | 343/725 |
| 4,816,838 | 3/1989 | Mizuno et al. | 343/771 |
| 4,817,196 | 3/1989 | Macnak et al. | 343/718 |
| 4,862,181 | 8/1989 | Ponce de Leon et al. | 343/702 |
| 4,862,516 | 8/1989 | Macnak et al. | 343/718 |
| 4,873,527 | 10/1989 | Tan | 343/718 |
| 4,884,252 | 11/1989 | Teodoridis et al. | 343/718 |
| 4,920,353 | 4/1990 | Mori et al. | 343/718 |
| 4,955,084 | 9/1990 | Umetsu et al. | 343/702 |
| 4,973,944 | 11/1990 | Maletta | 340/568 |
| 4,975,711 | 12/1990 | Lee | 343/702 |
| 4,977,614 | 12/1990 | Kurcbart | 343/718 |
| 4,980,694 | 12/1990 | Hines | 343/702 |
| 5,001,778 | 3/1991 | Ushiyama et al. | 343/702 |
| 5,007,105 | 4/1991 | Kudoh et al. | 343/718 |
| 5,048,118 | 9/1991 | Brooks et al. | 343/702 |
| 5,079,559 | 1/1992 | Umetsu et al. | 343/702 |
| 5,113,196 | 5/1992 | Ponce de Leon et al. | 343/702 |
| 5,128,686 | 7/1992 | Tan et al. | 343/718 |
| 5,132,697 | 7/1992 | Tan | 343/718 |
| 5,134,418 | 7/1992 | Gomez et al. | 343/718 |
| 5,134,724 | 7/1992 | Gehring et al. | 343/718 |
| 5,144,325 | 9/1992 | Kurcbart | 343/718 |
| 5,179,733 | 1/1993 | Matsui | 455/344 |
| 5,182,568 | 1/1993 | Stamps, Jr. et al. | 343/702 |
| 5,227,804 | 7/1993 | Oda | 343/702 |
| 5,231,407 | 7/1993 | McGirr et al. | 343/702 |
| 5,280,296 | 1/1994 | Tan et al. | 343/718 |
| 5,280,646 | 1/1994 | Koyama et al. | 343/718 |
| 5,465,098 | 11/1995 | Fujisawa et al. | 343/767 |

FOREIGN PATENT DOCUMENTS

| | | |
|---|---|---|
| 2-140002 | 5/1990 | Japan . |
| 3-88404 | 4/1991 | Japan . |
| 3147406 | 6/1991 | Japan . |
| 3-181208 | 7/1991 | Japan . |
| 4211522 | 8/1992 | Japan . |
| 1503570 | 7/1981 | United Kingdom . |
| 2165396 | 4/1986 | United Kingdom . |
| 2201266 | 8/1988 | United Kingdom . |
| 2217112 | 10/1989 | United Kingdom . |
| 2216726 | 10/1989 | United Kingdom . |
| 229319 | 9/1990 | United Kingdom . |
| 2240219 | 7/1991 | United Kingdom . |
| 2248522 | 4/1992 | United Kingdom . |
| 2251520 | 7/1992 | United Kingdom . |
| WO91/02386 | 2/1991 | WIPO . |
| PCT/JP92/ 00831 | 7/1992 | WIPO . |

WRIST-TYPE WIRELESS INSTRUMENT AND ANTENNA APPARATUS

CROSS-REFERENCE TO RELATED APPLICATION

This application is a continuation-in-part application of U.S. application Ser. No. 08/081,380 filed Jun. 29, 1993, now U.S. Pat. No. 5,465,098.

BACKGROUND OF THE INVENTION

1. Field of the Invention

This invention relates to a wrist-type wireless instrument in which an antenna body, unitarily formed with a wrist band, functions as a slot antenna and, in particular, to an antenna apparatus for attaining an improvement in terms of antenna gain.

2. Description of Related Art

FIG. 1 shows the structure of an antenna body 1, which is an example of the wrist-type wireless instrument in which an antenna body, unitarily formed with a wrist band, functions as a slot antenna. A strip-shaped conductive plate 2 is fastened to a wrist band, and a narrow slot 3 is formed so as to extend along the length dimension of the wrist band, thereby dividing the conductive plate 2 into two sections 2*a* and 2*b*. In FIG. 1, the wireless instrument is shown in the state in which it is placed on a person's wrist, i.e., the conductive plate 2 is looped. A capacitive element 4 is electrically connected across the sections 2*a* and 2*b* of the conductive plate 2. By appropriately adjusting the capacitance value of this capacitive element 4, it is possible for the antenna to be tuned to a desired frequency. It is desirable that the capacitive element 4 be electrically connected approximately in the central portion with respect to the length dimension of the conductive plate 2 because in this portion the current distribution can be well balanced and a large antenna gain can be obtained. Feeders 5*a* and 5*b*, connected to the conductive plate sections 2*a* and 2*b* respectively, are connected to a wireless instrument circuit section (not shown).

FIG. 2 shows the radiation pattern of this antenna. The drawing shows the vertical polarization component in the X-Y plane, which is normalized in maximum antenna gain. The radiation is maximum in the direction of the X-axis, which corresponds to the loading direction of the capacitive element 4. This fact indicates that the antenna is functioning as a slot antenna.

However, in this slot antenna for wrist-type wireless instrument, which is unitarily formed with the wrist band, the antenna is restricted to rather small dimensions, so that it is rather difficult to obtain a sufficient level of antenna gain. Thus, with the conventional antenna, it has been difficult to maintain a satisfactory radio communication quality.

SUMMARY OF THE INVENTION

The present invention has been made with a view toward solving the above problem. It is an object of the present invention to provide an improved antenna structure for a wrist-type wireless instrument or antenna apparatus of the type in which an antenna body, formed unitarily with the wrist band, functions as a slot antenna, wherein the space inside the wireless instrument casing is effectively utilized, thereby providing a simple structure which helps to obtain an antenna gain larger than that in the prior art.

To solve the above problem, the present invention provides a wrist-type wireless instrument that includes a casing containing a circuit board; a wrist band connected to either side of the casing; and a conductive plate having a slot and provided in the casing and in the wrist band, wherein a capacitive element is loaded across conductive sections of a conductive plate that are defined by a slot, wherein the circuit board is arranged on the inner side of a loop for wrist wear that is formed by the casing and the wrist band, and wherein the capacitive element is arranged approximately at the center of the circuit board.

More specifically, it is desirable that the wrist band be comprised of two (first and second) wrist band members that are respectively joined to each side of the casing. It is also desirable that the conductive plate be comprised of two (first and second) conductive plates and two electric paths provided in the casing, the two electric paths and the two conductive plates being respectively provided for the two wrist band members, a slot being formed in each conductive plate so as to extend longitudinally from the end edge of the casing to which the associated wrist band member is joined, thereby dividing each conductive plate into first and second sections.

Additionally, it is desirable that, on the casing side, the ends of the respective first sections of the first and second conductive plates be electrically connected to each other through one of the two electrical paths, the ends of the respective second sections of the first and second conductive plates being electrically connected to each other through the other of the two electrical paths, with the capacitive element being loaded between the two electric paths.

Further, it is desirable that the capacitive element be arranged between a display element for displaying information of the wrist-type wireless instrument and the circuit board. Alternatively, the capacitive element may be surface-mounted on the circuit board.

Further, it is possible for the capacitive element to be comprised of two varactor diodes that are connected in series.

BRIEF DESCRIPTION OF THE DRAWINGS

Embodiments of the present invention are described hereafter, with reference to the drawings, in which.

The operation of the antenna apparatus of the present invention will now be described. First, the operation of a wrist-type antenna apparatus will be described.

Figure 4:
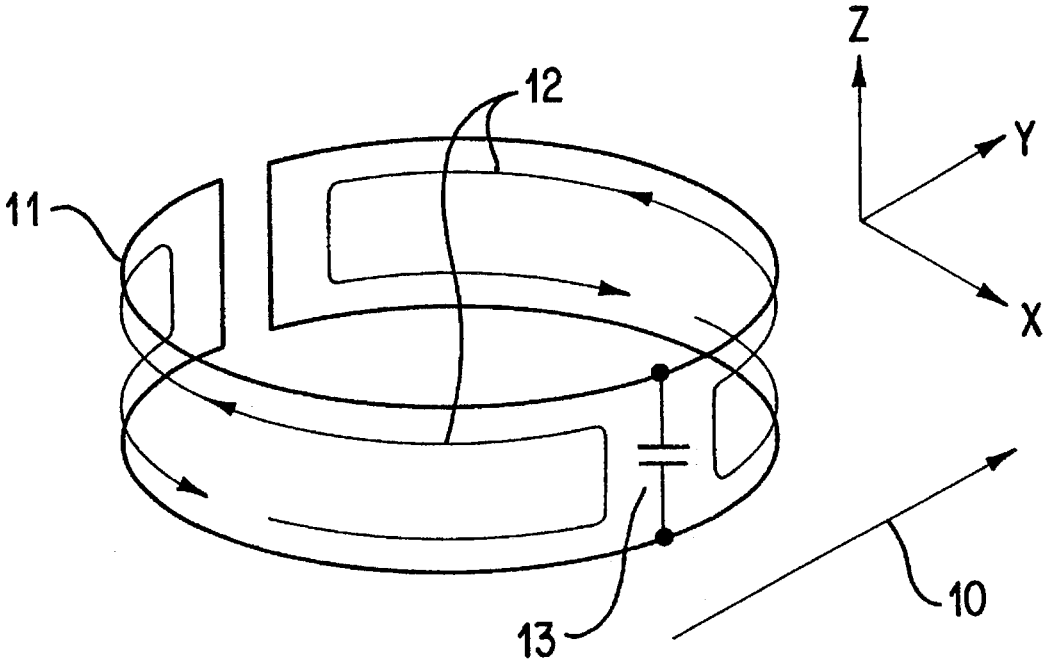
FIG. 4 illustrates the operational principle of the wrist-type wireless instrument antenna apparatus shown in FIG. 1.

FIG. 4 shows the operational principle of a wrist-type-wireless instrument antenna apparatus. A slot antenna is a magnetic-field-detection type antenna, whose vertical-polarization magnetic field component 10 is in the horizontal direction, as shown in the drawing. In this condition, the directions of electric current flowing through the conductive plate are as indicated at 12. Here, the conductive plate 11 is shown in a diagrammatic form, with a capacitive element 13 being loaded thereon. These two directions of current are in the same phase when seen in the direction of the Y-axis, representing an appearance as if two loop antennas are connected in parallel. When the conductive plate 11 is thus looped, the direction of current of the slot antenna and that of the loop antenna coincide with each other, so that the antenna apparatus is functioning not only as a slot antenna but also as a loop antenna. The two are combined together to make it possible to obtain a relatively large antenna gain.

Figure 1:
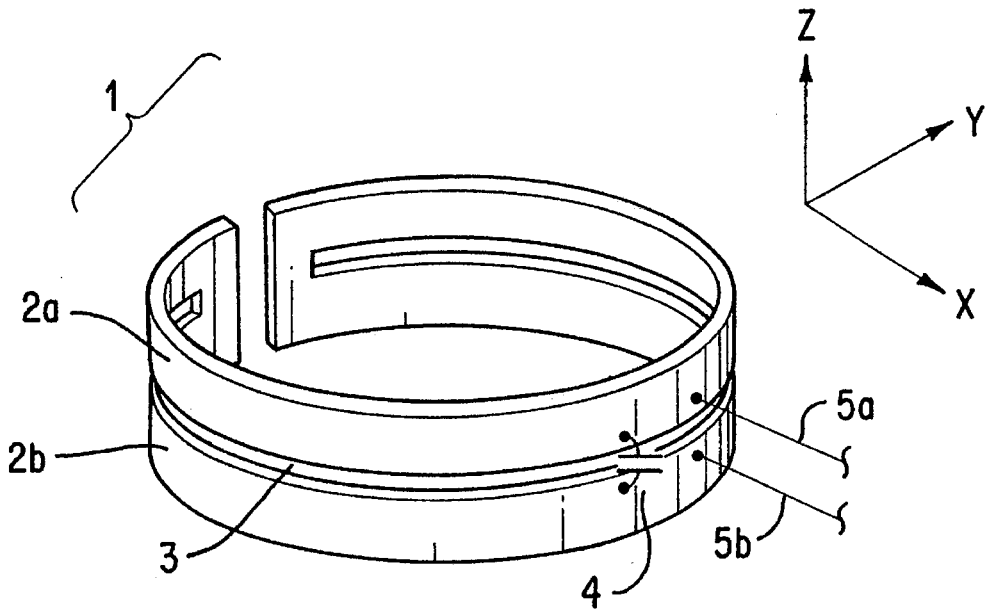
FIG. 1 PRIOR ART
FIG. 1 illustrates the construction of a conventional, prior art wrist-type wireless instrument antenna apparatus.
Figure 2:
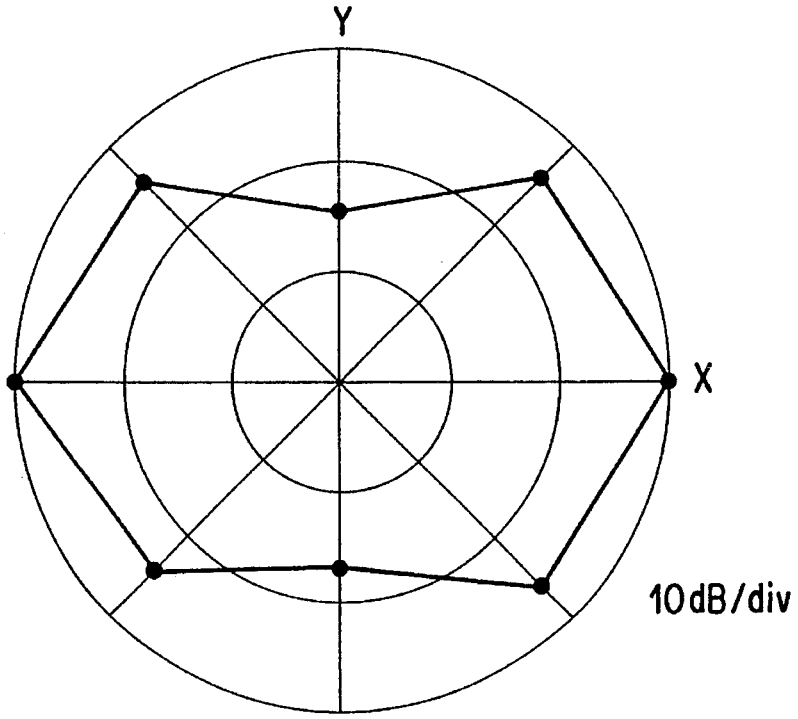
FIG. 2 PRIOR ART
FIG. 2 is a graph showing the radiation directivity characteristic of a conventional, prior art wrist-type wireless instrument antenna apparatus.
Figure 3:
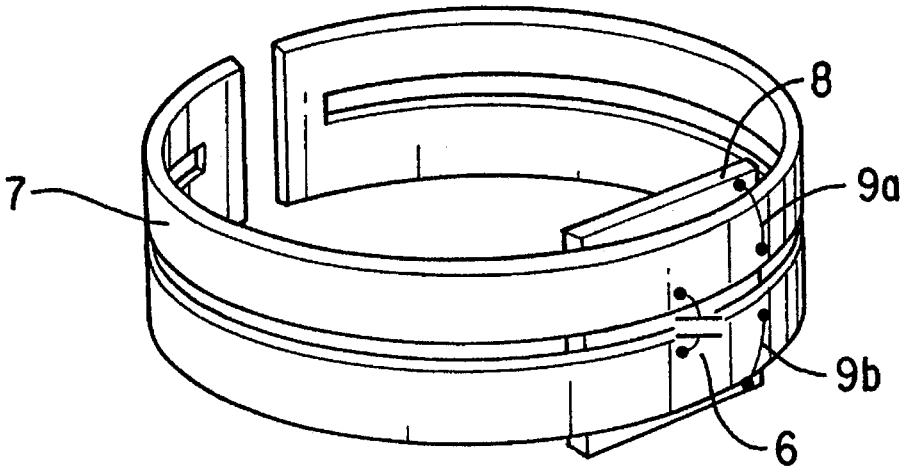
FIG. 3 illustrates the construction of a wrist-type wireless instrument antenna apparatus according to the present invention.

As shown in FIG. 3, in the antenna apparatus of the present invention, a conductive plate 7 and a capacitive element 6, loaded on the central portion with respect to the longitudinal direction of the conductive plate 7, are arranged on the outer side of a circuit board 8 (conversely, the circuit board 8 is arranged on the inner side of the loop formed by the conductive plate 7), and the capacitive element 6 is situated approximately at the center of the circuit board 8. The reason for this arrangement is to effectively utilize the circuit board 8, which is a conductive plate, as an antenna reflector, thereby attaining an increase in antenna gain. Further, the conductive plate 7 and the circuit board 8 are connected together through feeders 9*a* and 9*b*.

To obtain a larger antenna gain, according to the present invention, the circuit board of a wrist-type wireless instrument is utilized as the reflector of a slot antenna. The effect of this arrangement will be described below.

Figure 5A:
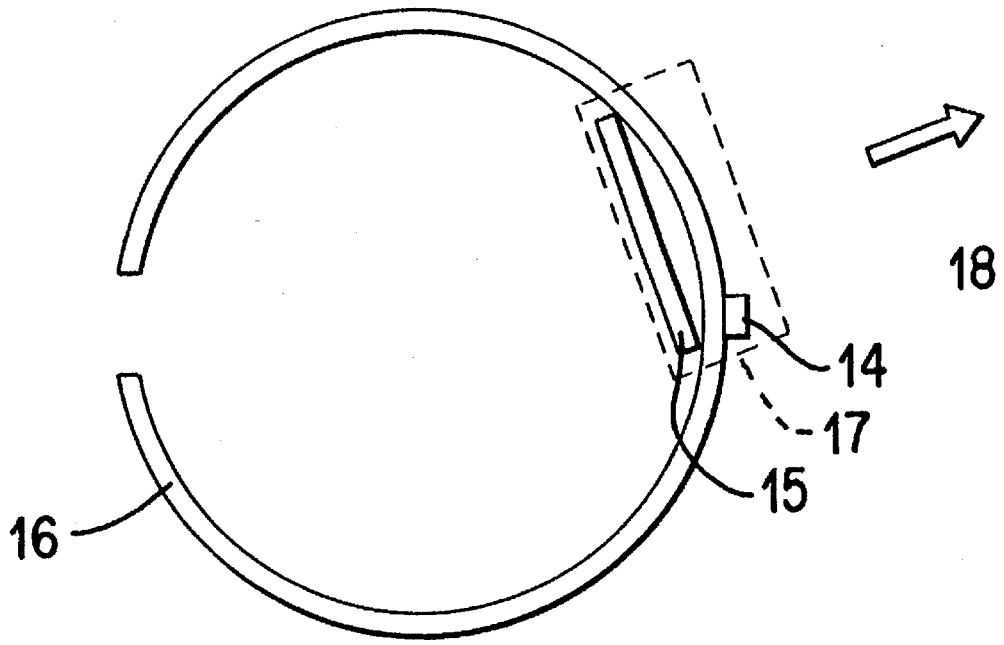
FIGS. 5(*a*) and 5(*b*) are diagrams illustrating antenna characteristics, which depend on the position and arrangement of the capacitive element, of which FIG. 5(*a*) is a plan view of a wrist-type wireless instrument antenna apparatus and FIG. 5(*b*) is a side view thereof.
Figure 5B:
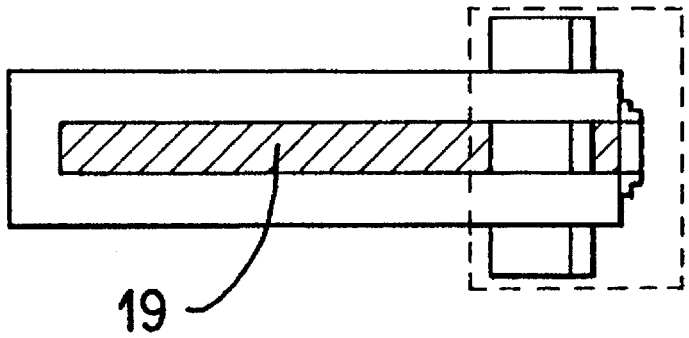
Figure 6A:
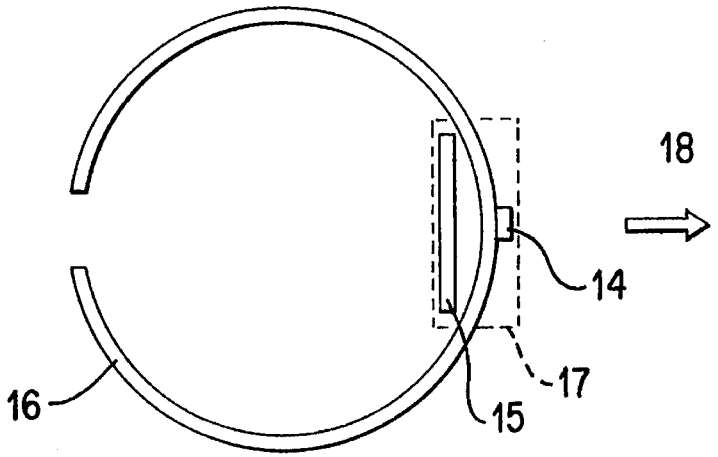
FIGS. 6(*a*) and 6(*b*) are diagrams illustrating the operation of the present invention (the antenna characteristic depending on the position of arrangement and the capacitive element), of which portion 6(*a*) is a plan view of a wrist-type wireless instrument antenna apparatus according to the present invention and FIG. 6(*b*) is a side view thereof.
Figure 6B:
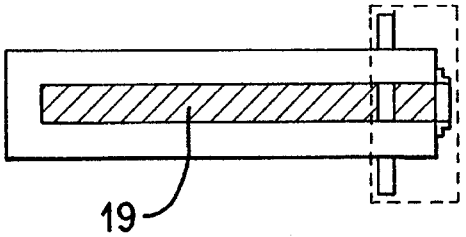

In FIGS. 5 and 6, a capacitive element 14, a wireless instrument circuit board 15, and a part of a conductive plate 16 are arranged inside a wireless instrument casing 17.

FIG. 5(*a*) is a plan view of the antenna apparatus, and FIG. 5(*b*) is a side view thereof. When, as shown in FIG. 5(*a*) and FIG. 5(*b*), the capacitive element 14, which is in the central portion with respect to the longitudinal dimension of the conductive plate 16, is arranged so as to be situated at an end of the circuit board 15, an electromagnetic wave 18 that is reflected by the circuit board 15 is radiated in a direction inclined with respect to the frontal direction of the antenna, so that the effect of the slot antenna as the reflector is diminished. Moreover, as shown in FIG. 5(*b*), the effective opening area of a slot 19 (the shaded portion in FIG. 5(*b*)) is reduced, so that the characteristic of the apparatus as a loop antenna deteriorates, resulting in a reduction in antenna gain.

Similarly, FIG. 6(*a*) is a plan view of an antenna apparatus, and FIG. 6(*b*) is a side view thereof. Since the structure shown is similar to that of FIGS. 5(*a*) and 5(*b*), the components which correspond to those of FIG. 5(*a*) and 5(*b*) are indicated by the same reference numerals. When, as shown in FIG. 6(*a*) and FIG. 6(*b*), the capacitive element 14, which is in the central portion with respect to the longitudinal dimension of the conductive plate 16, is arranged so as to be situated at the center the circuit board 15, the electromagnetic wave 18, reflected by the circuit board 15, is radiated in the frontal direction of the antenna, so that the effect of the slot antenna as a reflector is maximum. Further, as shown in FIG. 6(*b*), which is a side view of FIG. 6(*a*), the reduction in the effective opening area of the slot 19 (the shaded portion in FIG. 6(*b*)) is restrained to a minimum, so that there is practically no deterioration in the characteristic of the apparatus as a loop antenna, resulting in a maximum antenna gain. The effect of the reflector in the optimum antenna-apparatus construction as shown in FIGS. 6(*a*) and 6(*b*) is such that an improved antenna gain of approximately 2 or 3 dB can be obtained.

DETAILED DESCRIPTION OF PREFERRED EMBODIMENTS

Embodiments of the present invention will now be described in detail with reference to the drawings.

Figure 7:
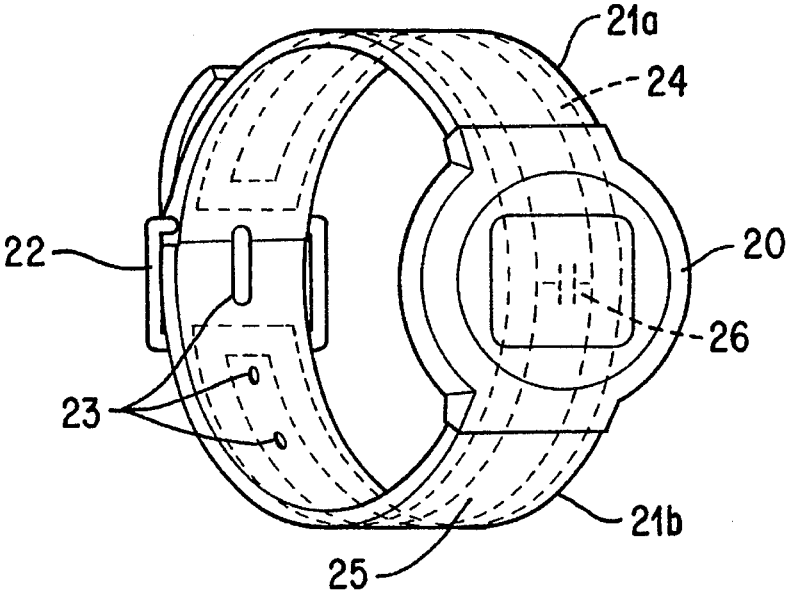
FIG. 7 is a schematic perspective view of a wrist-type wireless instrument equipped with a wrist-type wireless instrument antenna apparatus according an embodiment of the present invention.

FIG. 7 is a schematic perspective view of a wrist-type wireless instrument (an antenna apparatus for wrist-type wireless instrument) according to an embodiment of the present invention. In the drawing, the wrist-type wireless instrument comprises: a casing 20 containing a wireless instrument circuit; and first and second band members 21*a* and 21*b* respectively connected to each longitudinal end of the casing 20. A band clasp 22 is attached to the other end of the first band member 21*a*, and a plurality of clasp holes 23 capable of being mechanically engaged with the band clasp 22 are formed in the second band member 21*b*.

A metal conductive plate 24 is fastened to the first and second band members 21*a* and 21*b*, a slot 25 being longitudinally formed in the conductive plate 24. The conductive plate 24 is arranged on the inner side of the first and second band members 21*a* and 21*b*. When the band members 21*a* and 21*b* are formed of a synthetic resin, such as urethane or silicone resin, it is possible for the band members 21*a* and 21*b* and the conductive plate 24 to be formed integrally. When the band members 21*a* and 21*b* are formed of leather, the conductive plate 24 is sewed in between the outer and inner sheets of leather.

A capacitive element 26, which comprises, for example, a variable capacitor, is loaded on the conductive plate 24, at a position which is in the central portion with respect to the longitudinal dimension of the conductive plate 24 and which is between the two sections, defined by the slot 25, of the conductive plate 24. By appropriately adjusting the capacitance value of this capacitive element 26, it is possible to tune the antenna apparatus to a desired frequency. If the wireless instrument only uses a single frequency, a fixed or semi-fixed capacitor suffices for the capacitive element 23.

Figure 8A:
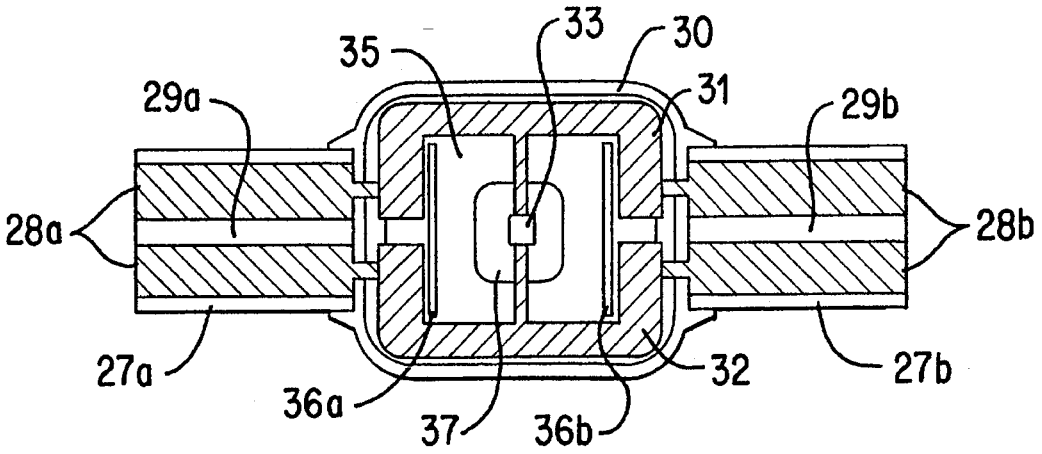
FIGS. 8(*a*) and 8(*b*) are diagrams showing a wrist-type wireless instrument antenna apparatus according an embodiment of the present invention, of which FIG. 8(*a*) is a cutaway top view showing the structure of a near-casing portion thereof and FIG. 8(*b*) is a cutaway side view thereof.
Figure 8B:
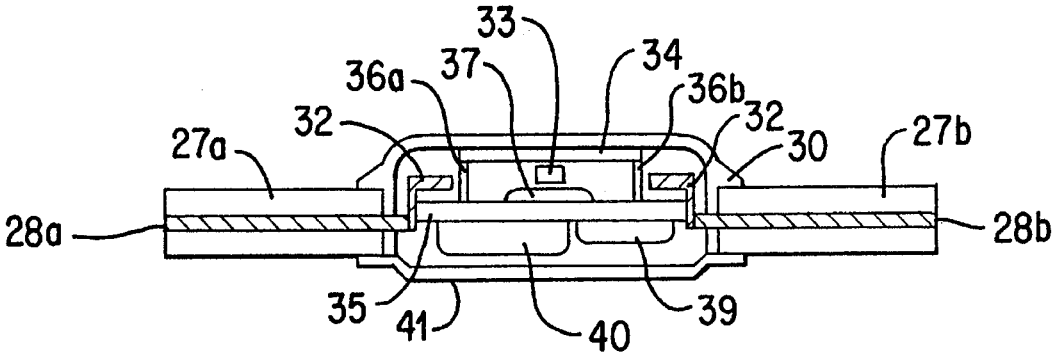

FIG. 8(*a*) is a cutaway top view showing the structure of a near-casing portion of an embodiment of a wrist-type wireless instrument (an antenna apparatus for wireless instrument) according to the present invention; and FIG. 8(*b*) is a cutaway side view of the same. In FIG. 8(*a*) and FIG. 8(*b*), conductive plates 28*a* and 28*b*, which are respectively fixed to first and second band members 27*a* and 27*b*, have slots 29*a* and 29*b*, respectively, extending from their ends on the side of a wireless instrument casing 30 to thereby divide each of the first and second conductive plates 28*a* and 29*b* into first and second divided sections. The respective first divided sections of the conductive plates 28*a* and 28*b* are connected to each other through one of two electrical paths consisting of conductive plates 31 and 32 provided in the wireless instrument casing 30. Similarly, the respective second divisional sections of the conductive plates 28*a* and 28*b* are connected to each other through the other electrical path. The conductive plates 31 and 32, which may be metal plates, may also comprise flexible copper tapes covered with polyamide or the like. The connections between the conductive plates 28*a* and 28*b* and the conductive plates 31 and 32 are effected through conductive connections such as spring contact, soldering, or screwing.

In this embodiment, the conductive plate is divided into band and case sections. Of course it is also possible for the conductive plate to be formed as an integral piece as indicated in FIG. 7. However, the divided structure is advantageous in that the assembly of the casing section and that of the band section can be separately conducted, which increases the freedom in the production of the wrist-type wireless instrument.

A capacitive element 33, which includes a variable capacitor or the like, is connected to the conductive plates 31 and 32, and is situated approximately in the central portion with respect to the longitudinal dimension of the antenna body inclusive of the conductive plates 28*a* and 28*b*. The capacitive element 33 is arranged in the space between a display device 34, which includes, for example, a liquid crystal device, for indicating information of the wrist-type wireless instrument, and a circuit board 35, and situated substantially at the center of the circuit board 35. The circuit board 35 is a glass-epoxy-type or the like, multi-layered double-sided circuit board, having a printing pattern on either side. In its inner layer, the circuit board 35 has a power source and a grounding pattern.

The display device 34 is connected to the circuit board 35 through conductive connectors 36*a* and 36*b*. An integrated circuit (IC) 37 is arranged on the upper side of the circuit board 35. An IC 39, which is connected to the conductive plates 31 and 32 through feeders (not shown), and a battery 40 are arranged on the lower side of the circuit board 35. The casing 30 has a back cover 41, the material of which may be synthetic resin to reduce cost. However, when it is made of a metal, the effect of the antenna reflector is enhanced. Further, a metal cover has the effect of shielding against noise components generated from the wireless instrument circuit, so that a further improvement is achieved in terms of antenna gain.

In the construction described above, the capacitive element 33 is arranged in the space between the display device 34 and the circuit board 35, so that the space can be effectively utilized and the thickness of the wireless instrument body can be reduced. Further, since the circuit board 35 can be utilized most effectively as the antenna reflector, it is possible to obtain a larger antenna gain.

Figure 9:
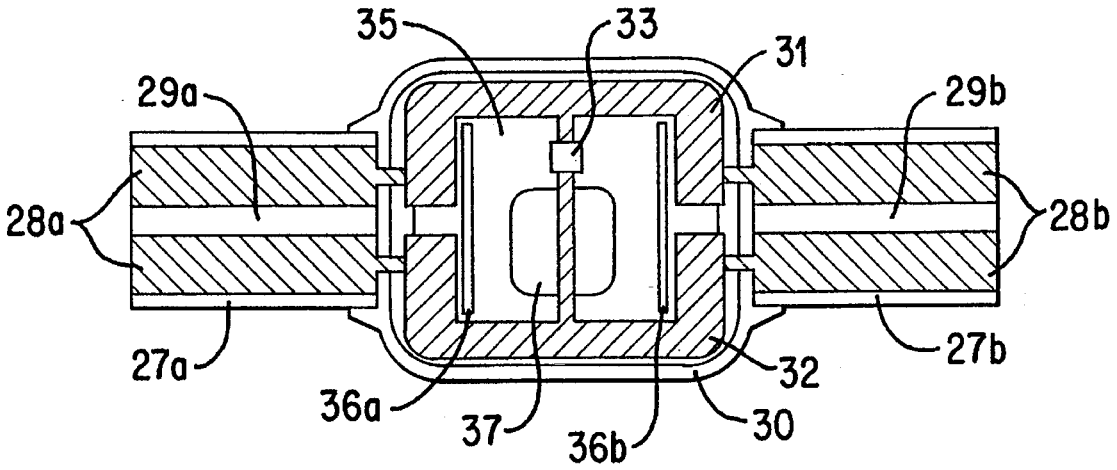
FIG. 9 is a cutaway top view showing the structure of a near-casing portion of a wrist-type wireless instrument that is equipped with a wrist-type wireless instrument antenna apparatus according to another embodiment of the present invention which is near the casing thereof.

FIG. 9 is a cutaway top view, showing the portion near the casing, of a wrist-type wireless instrument (an antenna apparatus for wrist-type wireless instrument) according to another embodiment of the present invention. The wrist-type wireless instrument (the antenna apparatus for wrist-type wireless instrument) of this embodiment is a modification of that shown in FIG. 8, and has substantially the same construction as the latter, so the corresponding components are indicated by the same reference numerals.

In FIG. 9, the capacitive element 34 is arranged between the display device 34 and the circuit board 35 but situated at a position shifted two-dimensionally such that it does not overlap the IC 37 (this position also is regarded to be substantially the center of the circuit board 35). Therefore, it is possible to reduce the gap between the display device 34 and the circuit board 35, so that a further reduction in the thickness of the wireless instrument casing 30 can be realized. In this construction also, the circuit board 35 can function as an antenna reflector, so that a large antenna gain can be obtained.

Figure 10A:
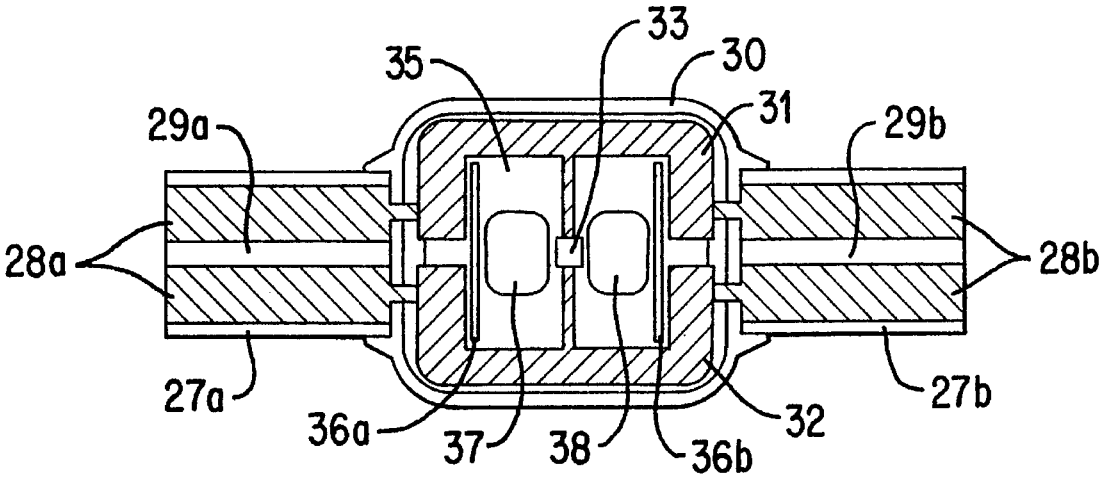
FIGS. 10(*a*) and 10(*b*) are diagrams showing still another embodiment of a wrist-type wireless instrument antenna apparatus according to the present invention, of which FIG. 10(*a*) is a cutaway top view showing the structure of a near-casing portion thereof and FIG. 10(*b*) is a cutaway side view thereof.
Figure 10B:
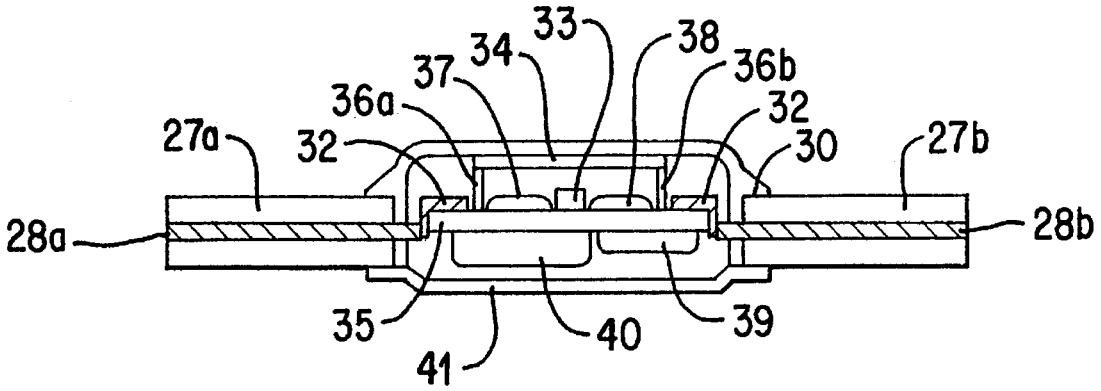

FIG. 10(*a*) is a cutaway top view, showing the portion near the casing, of a wrist-type wireless instrument (an antenna apparatus for wrist-type wireless instrument) according to still another embodiment of the present invention, and FIG. 10(*b*) is a cutaway side view of the apparatus. The wrist-type wireless instrument (the antenna apparatus for wrist-type wireless instrument) of this embodiment also has substantially the same construction as that shown in FIG. 8, so the corresponding components are indicated by the same reference numerals.

In FIGS. 10(*a*) and 10(*b*), the conductive plates 28*a* and 28*b*, fixed to the first and second band members 27*a* and 27*b*, respectively, have slots 29*a* and 29*b* formed so as to extend longitudinally from the end edges on the side of the wireless instrument casing 30. Thus, each of the conductive plates 28*a* and 28*b* is separated into first and second divided sections by the slots 29*a* and 29*b*, respectively. Their respective first divided sections are connected to each other through a conductive plate 31 provided in the wireless instrument casing 30. Similarly, their respective second divided sections are connected to each other through a conductive plate 32, which is also provided in the wireless instrument casing 30. The capacitive element 33, consisting of a variable capacitor or the like, is connected to the conductive plates 31 and 32 and situated substantially in the central portion with respect to the length dimension of the antenna inclusive of the conductive plates 28*a* and 28*b*. Further, the capacitive element 33 is surface-mounted on the circuit board 35, at a position below the display device 34, including a liquid crystal panel or the like for displaying information of the wrist-type wireless instrument, and is positioned substantially at the center of the circuit board 35. The display device 34 is connected to the circuit board 35 through conductive connectors 36*a* and 36*b*. Arranged on the upper side of the circuit board 35 are ICs 37 and 38. On the lower side of the circuit board 35, an IC 39, which is connected to the connective plates 31 and 32 through feeders (not shown), and a battery 40 are arranged.

In the construction of this embodiment, the IC is comprised of two chips, and the capacitive element 33 is surface-mounted on the circuit board 35, so that it is possible to further reduce the gap between the display device 34 and the circuit board 35, thereby attaining a further reduction in the thickness of the casing body 30. Further, since the circuit board 35 can be utilized most effectively as an antenna reflector, the effect of providing a large antenna gain can be obtained as in the above-described embodiment.

Figure 11:
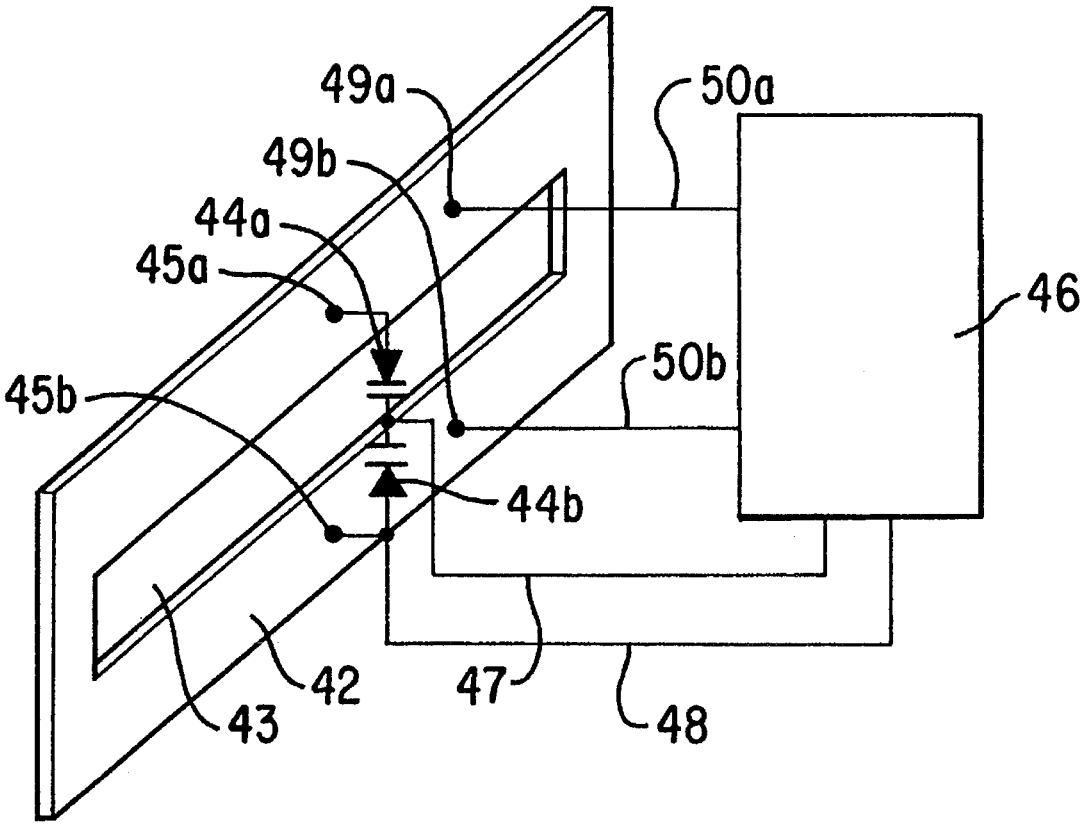
FIG. 11 is a circuit diagram illustrating a wrist-type wireless instrument antenna apparatus according an embodiment of the present invention.

FIG. 11 is a circuit diagram illustrating an embodiment of the wire-type-wireless instrument antenna apparatus of the present invention. The capacitive element, which is loaded across two divisional sections of a connective plate 42, defined by a slot 43, includes two varactor diodes 44*a* and 44*b* that are connected in series. The respective cathode terminals of the varactor diodes 44*a* and 44*b* are connected to each other, and further connected to a wireless instrument circuit 46, formed on the circuit board, through a signal line 47. The respective anode terminals of the varactor diodes 44*a* and 44*b* are connected to the connective plate 42, at central positions 45*a* and 45*b* with respect to the length dimension of the plate. The anode terminal of one of the varactor diodes 44*a* and 44*b* is connected to the wireless instrument circuit 46 through a signal line 48. The anode/cathode combination in the connection of the varactor diodes 44*a* and 44*b* is interchangeable. The wireless instrument circuit 46 is connected to feeding points 49*a* and 49*b* at appropriate positions on the connective plate 42 through feeders 50*a* and 50*b*. By appropriately adjusting the positions of these feeding points 49*a* and 49*b*, it is possible to change the antenna input impedance, thereby making it possible to achieve an optimum impedance matching with the wireless instrument circuit 46.

With the above arrangement, it is possible, in this wrist-type wireless instrument antenna apparatus, to use the varactor diodes 44*a* and 44*b* in a simple structure, and, by varying the voltages of the two signal lines 48 and 49 by the wireless instrument circuit 46, to change the tuning frequency of the antenna. Thus, it is possible to realize an automatic electronic tuning like that in a synthesizer system, so that a plurality of frequencies may be used.

As described above, the wrist-type wireless instrument and antenna apparatus of the present invention provide the following advantages. The limited space in the wrist-type wireless instrument can be effectively used, so that it is possible to realize a reduction in the thickness of the casing. Further, due to the structure which allows the circuit board to be used most effectively as a antenna reflector, it is possible to attain a still larger antenna gain.

Also, by the conductive plate being divided into band and casing sections, a substantial improvement in the producibility of the wrist-type wireless instrument is attained.

Additionally, it is possible to realize a further reduction in the thickness of the casing. Further, the operation of mounting the capacitive element is facilitated.

Also, a circuit is provided in which the capacitive element can be easily formed of varactor diodes, so that it is possible to change the tuning frequency when automatic electronic tuning is to be performed.

While this invention has been described in conjunction with specific embodiments thereof, it is evident that many alternatives, modifications and variations will be apparent to those skilled in the art. Accordingly, preferred embodiments of the invention as set forth herein are intended to be illustrative, not limiting. Various changes may be made without departing from the spirit and scope of the invention as defined in the following claims.

What is claimed is:

1. A wrist-type wireless instrument comprising:

a casing containing a circuit board;

a wrist band connected to said casing, said casing and said wrist band defining a loop when said instrument is in use;

a conductive plate having a slot and disposed within said casing and said wrist band, said conductive plate configured and disposed so as to function as a slot antenna; and a capacitive element electrically connected to opposing portions of said conductive plate, said opposing portions being separated by said slot;

wherein said circuit board is arranged so as to be disposed on an inner side of said loop and so as to function as an antenna reflector when said instrument is in use, and wherein said capacitive element is disposed near an approximately central portion of said circuit board.

2. A wrist-type wireless instrument according to claim 1, wherein said capacitive element is comprised of two varactor diodes connected in series.

3. A wrist-type wireless instrument according to claim 1, wherein:

said wrist band comprises first and second band members, said first and second band members being attached to opposite lateral sides of said casing;

said conductive plate comprises first and second plate members, said first and second plate members being disposed within said first and second band members, respectively, said first and second plate members each being divided into upper and lower plate member portions by a slot extending longitudinally from one end of the respective plate member, disposed at or near said casing, to an opposite, free end of the respective plate member;

said casing comprises a first electrical pathway by which the upper portions of said first and second plate members are electrically connected to each other, and a second electrical pathway by which the lower portions of said first and second plate members are electrically connected to each other; and wherein said capacitive element is electrically connected between said first and second electrical pathways.

4. A wrist-type wireless instrument according to claim 3, wherein said capacitive element is disposed between the circuit board and a display element for displaying information to a user of the wrist-type wireless instrument.

5. A wrist-type wireless instrument according to claim 3, wherein said capacitive element is mounted on a surface of the circuit board.

6. A wrist-type wireless instrument according to claim 3, wherein said capacitive element is comprised of two varactor diodes connected in series.

7. A wrist-type wireless instrument according to claim 1, wherein said conductive plate is configured and disposed so as to function simultaneously as a slot antenna and as a loop antenna.

8. An antenna apparatus for use in a wrist-type wireless instrument, comprising:

a casing containing a circuit board;

a wrist band connected to either side of said casing;

a conductive plate having a slot and disposed within said casing and within said wrist band; and a capacitive element electrically connected between opposing sections of said conductive plate, said opposing sections being separated by the slot;

wherein said circuit board is disposed on an inner side of a loop formed by said casing and said wrist band when said instrument is in use, said circuit board being located at an approximately central position along the length of said wrist band, and wherein the capacitive element is disposed near an approximately central portion of said circuit board;

said conductive plate functioning as a slot antenna and said circuit board functioning as an antenna reflector.

* * * * *